US007022011B1

(12) United States Patent
Rickman et al.

(10) Patent No.: US 7,022,011 B1
(45) Date of Patent: Apr. 4, 2006

(54) AIR DUCT EXPANDER

(76) Inventors: Dwayne Wilson Rickman, 1248 Chelsea Way, Concord, CA (US) 94521; Thomas Joseph Garbez, 1244 Chelsea Way, Concord, CA (US) 94521

( * ) Notice: Subject to any disclaimer, the term of this patent is extended or adjusted under 35 U.S.C. 154(b) by 0 days.

(21) Appl. No.: 10/927,739

(22) Filed: Aug. 27, 2004

Related U.S. Application Data

(60) Provisional application No. 60/585,440, filed on Jul. 6, 2004.

(51) Int. Cl.
*F24F 13/04* (2006.01)

(52) U.S. Cl. ..... 454/306; 454/903

(58) Field of Classification Search ..... 454/306, 454/903, 330, 322
See application file for complete search history.

(56) References Cited

U.S. PATENT DOCUMENTS 3,359,883 A * 12/1967 Murphy ..... 454/306
4,481,871 A * 11/1984 Efstratis ..... 454/306
4,628,799 A * 12/1986 Lang et al. ..... 454/306
4,850,266 A * 7/1989 Bennett ..... 454/338
4,967,646 A * 11/1990 Brown ..... 454/289
5,044,259 A * 9/1991 Catan et al. ..... 454/306
5,095,942 A * 3/1992 Murphy ..... 137/561 A
6,131,645 A * 10/2000 Barr ..... 165/41

* cited by examiner

*Primary Examiner*—Derek S. Boles
(74) *Attorney, Agent, or Firm*—Risto A. Rinne, Jr.

(57) ABSTRACT

An apparatus for directing air away from a register grill includes a shroud covering that is applied over the grill and a flexible conduit that is attached over an opening provided in the shroud. The flexible conduit is used to discharge air away from the grill where desired. A plurality of flexible conduits may be used with each grill. If desired, a detachable cover is used to obstruct air flow out of a discharge end of each flexible conduit. According to a modification, a section of rigid conduit is used in place of the flexible conduit. An intermediate section that is adapted to flex is attached to the shroud and disposed intermediate the grill and the rigid conduit to allow directional placement of the rigid conduit, where desired. The shroud is attached to the grill by screw fasteners, adhesive, magnetic means, or otherwise, as desired or it may be formed as an integral part of a replacement type of grill.

15 Claims, 2 Drawing Sheets

AIR DUCT EXPANDER

This application claims benefit of Provisional Patent Application Ser. No. 60/585,440, that was filed on Jul. 6, 2004, confirmation number 5996.

BACKGROUND OF THE INVENTION

1. Field of the Invention

The present invention, in general, relates to space heating and cooling systems and, more particularly, to directing air out of an air duct register.

Air ducts and the registers that cover them are well known in the heating and cooling industry. The ducts include conduits that are used to convey heated, cooled, or otherwise conditioned air (for example when moisture has either been added or removed from the air) throughout various rooms and areas of a structure. The structure includes any type of home, apartment, mobile home, recreational vehicle, or other type of residence, or it includes any office, retail outlet, or other type of commercial building.

The register includes a grill that covers an exposed end of each duct. Because air that is passing through the duct(s) is under a slight positive pressure, the registers are sometimes referred to as "forced air" registers. The area where the register is located is sometimes referred to as a "register outlet".

Registers are commonly disposed on wall surfaces or, alternately, on floor surfaces. The register includes a grill. The grill includes a plurality of openings through which air passes. The register (grill) may include a series of angled members that are used to direct the air in a general direction, usually either left or right or up or down, with respect to the register.

The register may also include a mechanical damper that can be partially closed to restrict an amount of air passing through the register or closed entirely to block virtually all of the air that is passing through the register. This is to control the amount of heating or cooling that is occurring and is useful in better regulating room temperature when either "hot spots" or "cold spots" occur.

While the above system of ducts and registers is useful in conveying treated air (heated or cooled) to a desired location, it does not take into account the effect that room furnishings have on the ability of the heating or cooling system to release the treated air into a desired space.

For example, a headboard of a bed disposed adjacent to a register in a wall can substantially impede the register from heating or cooling the room.

Similarly, a recliner type of a chair that is disposed over a floor mounted register can significantly obstruct the air flow occurring through the register and adversely affect the heating or cooling of the room.

Accordingly, there exists today a need for an air duct expander that helps ameliorate the above-mentioned difficulties.

Clearly, such an apparatus would be a useful and desirable device.

2. Description of Prior Art

Registers are, in general, known. The only known prior art supplemental type of a device includes a deflector that adheres magnetically to a register grill and which helps direct the air in a general direction. While the structural arrangements of the known prior types of devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide an air duct expander that is adapted for use with existing types of registers.

It is also an important object of the invention to provide an air duct expander that allows for greater versatility in the placement of furniture and other objects proximate the register.

Another object of the invention is to provide an air duct expander that is adapted for use as a replacement type of a register.

Still another object of the invention is to provide an air duct expander that is adapted to direct forced air through a register and to release the air into a room at a location that is distally disposed with respect to a register outlet that is disposed at a floor or wall surface.

Still yet another object of the invention is to provide an air duct expander that includes at least one conduit.

Yet another important object of the invention is to provide an air duct expander that is adapted to pass under or around furniture.

Still yet another important object of the invention is to provide an air duct expander that is unobtrusive in its appearance.

A first continuing object of the invention is to provide an air duct expander that prevents blockage of a register.

A second continuing object of the invention is to provide an air duct expander that includes at least one flexible conduit.

A third continuing object of the invention is to provide an air duct expander that is adapted for use with either a wall register or a floor register.

Briefly, an air duct expander that is constructed in accordance with the principles of the present invention has a register shroud that is adapted for placement over an end of an air duct register. At least one conduit is attached to the shroud and is adapted to discharge a quantity of air that is passing through the air duct at a distal location with respect to the shroud. The expander is adapted for attachment on an existing register grill or it can replace the existing register grill. Various modifications and methods of attachment are described.

DETAILED DESCRIPTION OF THE INVENTION

Figures 1, 3:
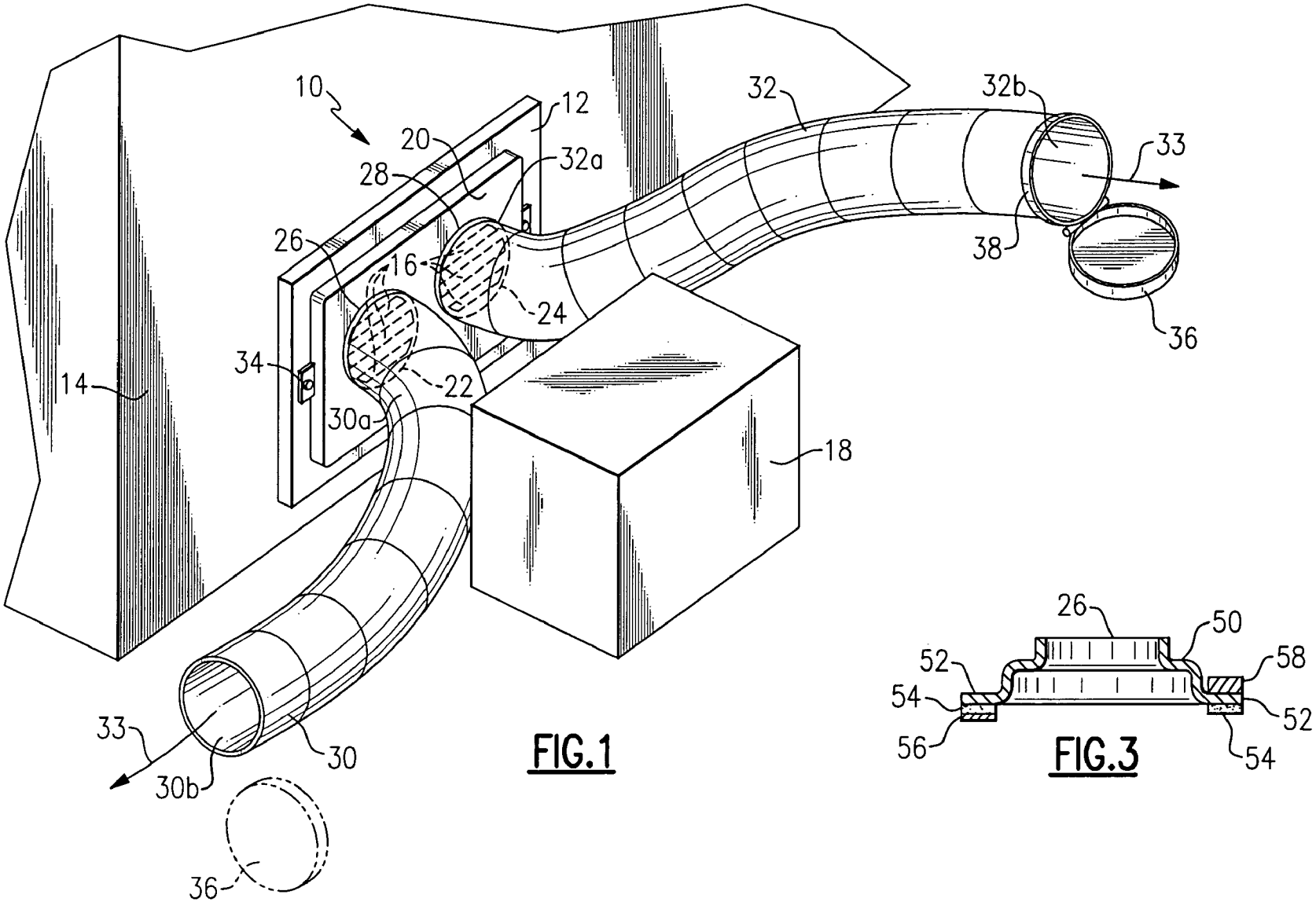
FIG. 1 is a view in perspective of an air duct expander attached to a wall register.
FIG. 3 is a view in cross-section of a modified shroud for use with the air duct expander.

Referring to all of the drawings and in particular now to FIG. 1 is shown, an air duct expander, identified in general by the reference numeral 10.

A register grill 12 (see FIG. 2) is attached to a wall 14. The air duct expander 10 is equally adapted for use when the register grill 12 is on a floor. The description herein applies equally for use with either a floor or wall type of register grill 12. Use of the air duct expander 10 on a floor mounted register grill 12 can be visualized if the wall 14 is momentarily considered instead to be the floor.

The register grill 12 includes a plurality of openings 16 (shown in dashed lines) through which heated or cooled air flows under pressure and is normally discharged into the room.

To illustrate the utility of the air duct expander 10, an object 18 is disposed directly in front of the register grill 12. The object 18, absent the air duct expander 10, would obstruct the flow of air through the register grill 12.

It is assumed that a duct end [not shown], which includes a conduit, terminates behind the register grill 12 and is used to supply air under a slight positive pressure to the register grill 12. The conduit receives cooled or heated air from an air conditioner or hot air furnace or any apparatus capable of heating or cooling the air, as desired. Typically, a fan is used to supply the slight positive pressure that is required to urge the air through the conduit and out the register grill 12 when either heated or cooled air is demanded.

A shroud 20 is disposed over the register grill 12. The shroud 20, according to a first embodiment, covers all of the openings 16. The shroud 20 is a substantially planar base member that is attached to the register grill 12 by any of a variety of methods, as are described in greater detail hereinafter. The remaining component parts of the air duct expander 10 are attached to the shroud 20.

A first opening 22 and a second opening 24 are provided through the shroud 20. A first ring 26 is attached to the shroud 20 around the first opening 22 and a second ring 28 is attached to the shroud around the second opening 24.

A first flexible conduit 30 includes a register end 30*a* and a distal end 30*b*. The register end 30*a* fits around the first ring 26 and is secured thereto, either by friction, adhesive, or by a hose clamp (not shown).

A second flexible conduit 32 also includes a register end 32*a* and a distal end 32*b*. The register end 32*a* fits around the second ring 28 and is similarly secured thereto, either by friction, adhesive, or by a second hose clamp (not shown).

While the length of the first flexible conduit 30 and the second flexible conduit 32 is a variable or can be cut to length as preferred, a typical length for each will include at least a few feet, sufficient to permit placement of each where desired so that the distal ends 30*b*, 32*b* are disposed away from and sufficiently beyond the obstruction caused by the object 18.

When air (heated, cooled, or otherwise conditioned) is flowing through the register grill 12, it is prevented from being discharged into the room proximate the register grill 12 by the shroud 20. The air instead passes through the plurality of openings 16 in the register grill 12, through the first and second openings 22, 24 in the shroud 20, and into the first and second flexible conduits 30, 32 where it exits at the distal ends 30*b*, 32*b*, thereof, as shown by arrows 33.

As mentioned above, there are a variety of methods available for attaching the shroud 20 to the register grill 12. According to FIG. 1, a pair of register mounting screws 34 (only one shown) that are disposed on opposite sides of the register grill 12 and which are used to secure the register grill 12 in position on the wall 14 (or floor) are loosened and pass through holes provided in tabs that extend from the shroud 20. If desired, longer replacement screws may be substituted for the register mounting screws 34.

Referring momentarily to FIG. 3, a modified shroud 50 is shown. The modified shroud 50 is a view in cross-section taken across a center of the first ring 26 thereof. The modified shroud 50 includes a perimeter lip 52 that extends fully around the entire perimeter of the modified shroud 50. An adhesive 54 is provided along the bottom edge of the perimeter lip 52.

The adhesive 54 is used to fasten (i.e., adhere) the modified shroud 50 to an exposed surface the register grill 12 that extends beyond the plurality of openings 16. A peel off strip 56, shown in part, is first removed to expose the adhesive 54, and the modified shroud 50 is then placed on the register grill 12 surface so that it covers the plurality of openings 16.

If desired, magnets 58 can be attached where desired to the modified shroud 50 and used to magnetically attach (i.e., secure) the modified shroud 50 to the register grill 12. The magnets 58 are useful if the register grill 12 is formed of a ferrous material.

Figure 4:
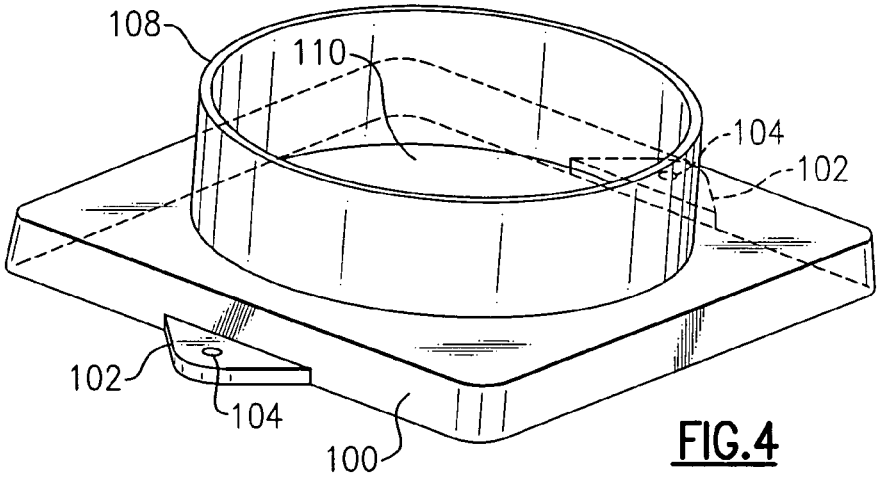
FIG. 4 is a view in perspective of a second modified shroud for use with the air duct expander.

Referring momentarily now to FIG. 4, a second modified shroud 100 is provided that is adapted to cover a portion of the register grill 12. A preferred type of the second modified shroud 100 is adapted to cover one-half of the register grill 12. The second modified shroud 100 includes a pair of modified tabs 102 that extend from opposite sides thereof and which each include a hole 104 for a mounting screw (not shown) to pass through.

Four mounting screw holes 106 (FIG. 2) are provided in the register grill 12 when the second modified shroud 100 is used. Two each of the mounting screw holes 106 are disposed on opposite sides of the openings 16 in the register grill 12 and are used with each of the second modified shrouds 100. The four mounting screw holes 106 are drilled, if required, into an existing type of the register grill 12, if it does not already include them.

A first mounting screw passes through the hole 104 in the modified tab 102 and then engages with one of the mounting screw holes 106. A second mounting screw passes through the hole 104 in the modified tab 102 on the opposite side of the openings 16 and engages with the mounting screw holes 106 on the opposite side of the register grill 12.

The mounting screw holes 106 are smaller in diameter than the holes 104. Accordingly, threads of the mounting screws pass through the holes 104 unimpeded and engage with the mounting screw holes 106 sufficient to secure each one of the second modified shrouds to the register grill 12.

A modified ring 108 is provided over a center opening 110 that is formed in the second modified shroud 100. The register end 30*a* of the first flexible conduit 30 is secured over the modified ring 108. The distal end 30*b* is placed at a desired location. The first flexible conduit 30 is placed where desired and can pass under or around the object 18, whichever is preferred.

The openings 16 in the register grill 12 are separated, typically, into a left and right half with a solid center portion between the two opening 16 halves. Each one of the second modified shrouds 100 is used to cover one-half of the openings 16 (on either side), as desired. This allows the other half to pass air normally through the remaining openings 16 in the register grill 12.

An advantage in using only one of the second modified shrouds 100 and of allowing the other half of the openings 16 to vent normally is that air (either heated or cooled) can be vented into a room at a first location that is at the register grill 12 and also at a distal location simultaneously.

If only a portion of the register grill 12 is obstructed by the object 18, for example, the second modified shroud 100 may be used, along with the first flexible conduit 30, to direct that portion of obstructed air to a location that is disposed away from the object 18.

A portion of air passing through the remaining openings 16 in the register grill 12 that is not blocked by the object 18 is permitted to vent at the register grill 12. This allows for the discharge of air at two planes, a first plane being at the register grill 12 and a second plane being at the distal end 30*b* of the first flexible conduit 30.

However, it is anticipated that two of the second modified shrouds 100 will typically be used together, each adjacent the other, with each of the second modified shrouds 100 secured to its corresponding pair of mounting screw holes 106 in the register grill 12. The second flexible conduit 32 is similarly secured to the modified ring 108 of the additional second modified shroud 100 and both the first and second flexible conduits 30, 32 are used to direct air away from the object 18, as desired, and to discharge the air at two planes both of which are distally disposed with respect to a plane of the register grill 12.

When the register grill 12 is disposed on a floor surface, it is used in like manner to that as described herein. The only difference is that the first and second flexible conduits 30, 32 extend upward from the floor instead of outward away from the wall 14.

Referring momentarily again to FIG. 1, a cover 36 is shown at the distal end 32*b* of the second flexible conduit 32. The cover 36 is placed over the distal end 32*b*, as desired, to obstruct or stop the air flow. A second cover 36 (shown in dashed lines) is disposed near the distal end of the first flexible conduit 30 and is used in like manner to obstruct air flow out of the distal end 30*b* thereof.

The two covers 36 are used to regulate the air flow at a two locations (i.e., at the two distal planes) that are disposed away from the register grill 12. This is an important benefit when the register grill 12 is disposed behind a large piece of furniture and is especially difficult to access.

Also, the register grill 12 may include a device that stops all of the air flow through the grill 12. If the register grill 12 is so equipped, there is no way to allow a portion of the air to pass through the register grill 12, for example through one side of the grill 12, but not through the other side. By using the two covers 36, one half of the openings 16 can be obstructed, as desired, at a remote location (a first distal plane) with respect to the grill 12 while the remaining half of the openings 16 is open to vent (at a second distal plane).

There are times when such ability is especially appreciated. For example, if the second flexible conduit 32 is used to direct warm, heated air in front of a recliner chair (not shown) that is seldom used, the cover 36 would normally remain on the distal end 32*b* of the second flexible conduit 32. If however, when company is present and when the company is using the recliner chair and it is especially chilly, an ability to remove the cover 36 and allow warm air to be discharged proximate the recliner chair would be especially desirable. This capability also saves energy (and reduces heating or cooling expenses) by not heating (or cooling) an unoccupied area unless heat is required in that specific area at a given time. The same example, of course, applies for summertime cooling needs, as well.

The cover 36 can be secured by friction-fit over the distal end 32*b*. Alternately, a collar 38 is attached at the distal end 32*b* and the cover 36 is hingedly attached to the collar 38. Accordingly, the cover 36 is pivoted up to close and down to open it.

Figure 2:
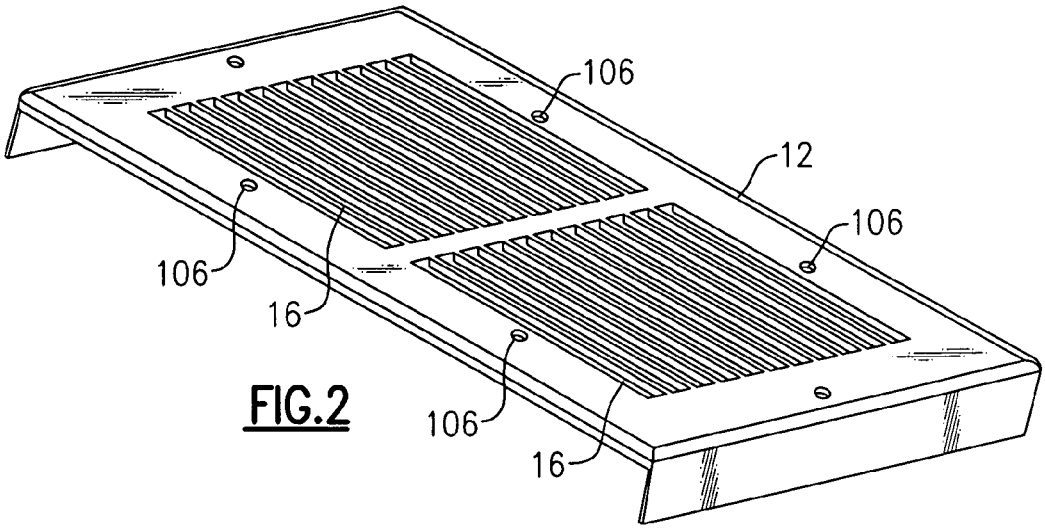
FIG. 2 is a view in perspective of a register grill.
Figure 5:
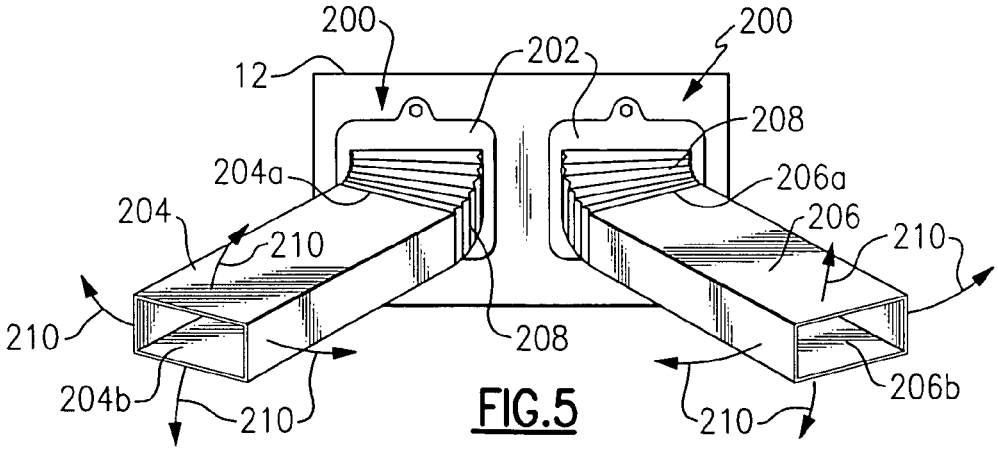
FIG. 5 is a view in perspective of a modified air duct expander attached to a wall register.

Referring now to FIG. 5, a pair of modified air duct expanders, each identified in general by the reference numeral 200, are attached to the register grill 12, in any preferred manner or similar to that as shown in FIG. 2.

A third modified shroud 202 is attached to the register grill 12. The third modified shroud 202 is similar in construction to that of the second modified shroud 100.

A first rigid section of conduit 204 and a second rigid section of conduit 206 are provided. The first and second rigid sections of conduit 204, 206 include a rectangular cross section, although any shape is possible. The rectangular cross section allows for a lower height and easier passage under certain types of furniture.

A register end 204*a*, 206*a* of the first and second rigid sections of conduit 204, 206 are each attached to an intermediate section 208. A distal end 204*b*, 206*b* of each of the first and second rigid sections of conduit 204, 206 is open to vent at the first and second distal plane locations with respect to the register grill 12. Of course, a modified cover, not shown, can be attached as desired at each distal end 204*b*, 206*b* to regulate air flow.

The intermediate section 208 includes a plurality of accordion folds. The accordion folds of each intermediate section 208 allow for the first and second rigid sections of conduit 204, 206 to be moved side to side, and slightly up or down, as well, as shown by arrows 210.

The distal ends 204*b*, 206*b* of the first and second rigid sections of conduit 204, 206 are offset as desired to direct conditioned air beyond the object 18 (not shown in FIG. 5).

Accordingly, the entire length of conduit need not be flexible as long as a portion that is capable of flexing is provided. The accordion folds of the intermediate sections 208 provide the flexing that is necessary to direct the air where desired. Other ways of providing flexing are also anticipated, for example, by use of a hinged type of a connection.

However, flexing at some location between the register grill 12 and the distal ends 30*b*, 32*b*, 204*b*, 206*b* is required for optimum benefit, as there is no way to know ahead of time where the object 18 may be placed. In order to direct the air under or to the side of the object 18, either the first flexible conduit 30, the second flexible conduit 32 are used or, alternately, the first rigid section of conduit 204 and the second rigid section of conduit 206 is used along with two of the intermediate sections 208 in order to provide an ability to offset the direction that the rigid sections 204, 206 extend away from the register grill 12.

Any version of the air duct expander 10, 200 described herein can be modified so as to include the register grill 12 as an integral part thereof. Instead of attaching the air duct expander 10 or the modified air duct expander 200 to the register grill 12, a modified type of grill is supplied as an integral part of the air duct expander 10, 200 and is used to replace the register grill 12 when the air duct expander 10, 200 is installed. The modified type of grill is similar to the register grill 12 and is attached during manufacture of the expander 10, 200 to any preferred version of the shroud 20, 100, 202.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. An air duct expander, comprising:

(a) a planar base member adapted for attachment to a register outlet, and wherein said planar base member includes a shroud, and wherein said shroud includes means for attaching said shroud to a register grill, said register grill attached to said register outlet, and wherein said register grill includes a plurality of openings and wherein said shroud covers a portion of said openings; and (b) means for directing a quantity of air that is adapted to be discharged from said register outlet to a location that is disposed a predetermined distance away from said register outlet, said means for directing a quantity of air attached at a first end thereof to said planar base member.

2. The air duct expander of claim 1 wherein said means for directing a quantity of air includes a flexible conduit.

3. The air duct expander of claim 1 wherein said means for directing a quantity of air includes a rigid conduit.

4. The air duct expander of claim 3 including an intermediate section attached to said planar base member, and wherein a first end of said rigid conduit is attached to said intermediate section and wherein said intermediate section includes means for flexing sufficient to allow a variation in a direction a longitudinal axis of said rigid conduit extends away from said planar base member.

5. The air duct expander of claim 4 wherein said means for flexing includes a plurality of accordion folds.

6. The air duct expander of claim 1 wherein said planar base member includes a shroud.

7. The air duct expander of claim 6 wherein said shroud includes means for attaching said shroud to a register grill, said register grill attached to said register outlet.

8. The air duct expander of claim 1 wherein said means for attaching said shroud to said register grill includes an adhesive.

9. The air duct expander of claim 1 wherein said means for attaching said shroud to said register grill includes a magnet.

10. The air duct expander of claim 1 wherein said means for attaching said shroud to said register grill includes a fastener.

11. The air duct expander of claim 10 wherein said fastener includes a plurality of screws.

12. The air duct expander of claim 7 wherein said register grill includes a plurality of openings and wherein said shroud covers a portion of said openings.

13. The air duct expander of claim 1 wherein said register grill includes a plurality of openings and wherein said shroud covers all of said openings.

14. An air duct expander, comprising:

(a) a planar base member attached to a register outlet;

(b) at least one rigid conduit attached to said planar base member, wherein said conduit is adapted to discharge a quantity of air at a location that is disposed a predetermined distance away from said planar base member, and including an intermediate section attached at a first end of said intermediate section to said planar base member, and wherein a first end of said rigid conduit is attached to a second end of said intermediate section and wherein said intermediate section includes means for flexing sufficient to allow for variation in a direction of a longitudinal axis of said rigid conduit that extends away from said planar base member, and wherein said means for flexing includes a plurality of accordion folds.

15. The air duct expander of claim 14 wherein said planar base member includes a register grill.

* * * * *